United States Patent [19]

Persson

[11] 4,180,292

[45] Dec. 25, 1979

[54] ROCK MILLING CUTTER TONGUE AND SLOT CONNECTED

[75] Inventor: Erik A. Persson, Sandviken, Sweden

[73] Assignee: Sandvik Aktiebolag, Sandviken, Sweden

[21] Appl. No.: 881,603

[22] Filed: Feb. 27, 1978

[51] Int. Cl.[2] ..... E21C 35/18

[52] U.S. Cl. ..... 299/92; 37/142 A; 408/66

[58] Field of Search ..... 299/91-93; 175/413; 37/142 A; 408/66

[56] References Cited

U.S. PATENT DOCUMENTS

| | | | |
|---|---|---|---|
| 3,305,274 | 2/1967 | Goodfellow et al. | 299/92 |
| 3,666,321 | 5/1972 | Lundstrom | 299/93 |
| 3,820,849 | 6/1974 | Lundstrom | 299/93 |

FOREIGN PATENT DOCUMENTS

| | | | |
|---|---|---|---|
| 91166 | 4/1968 | France | 299/92 |

*Primary Examiner*—Ernest R. Purser

*Attorney, Agent, or Firm*—Burns, Doane, Swecker & Mathis

[57] ABSTRACT

A plurality of cutter tool holders are mounted to a milling cutter head by tongue and groove connections. Each connection comprises a groove formed in the cutter head and a tongue formed on the tool holder. The groove has an undercut portion and an enlargement at one end. The tongue includes a projection which can be inserted into the enlargement and then into the undercut to prevent, via wedging action, dislodgement of the tool holder. The groove and tongue each includes a side wall which is straight along its height.

5 Claims, 10 Drawing Figures

ROCK MILLING CUTTER TONGUE AND SLOT CONNECTED

IMPROVEMENTS IN ROCK MILLING CUTTERS

In our British Pat. No. 1,344,010 we described and claimed a cutter tool holder assembly comprising a shank to be mounted in the cutter and a tool holder mounted in said shank by means of a tongue and groove connection. This tongue and groove connection was said to preferably be a T-slot connection, one part of the connection having a T-shaped tongue projecting from its body and fitting into the groove in the other part of the connection, the cross of the T providing one pair of the contact surfaces of the holder and the body providing respectively opposed contact surfaces of the holder.

In the parent patent specification we described the importance of ensuring that in such tongue and groove connection, the mouth of the groove should be narrowed by respective projections from opposite sides of the groove, each said projection having opposed contact surfaces which converge together in the direction from which the tongue part is mounted and engage corresponding contact surfaces on the tongue part.

With the above mentioned T-slot connection there is obtained a connection of sufficient strength but considerable costs are connected therewith to an extent that makes it desirable to find less expensive alternatives which still provide a connection of adequate stability and strength.

With a view to overcoming these difficulties we have, according to the present invention, eliminated use of a specifically T-form tongue and groove connection comprising a groove whose mouth is narrowed by two separate projections from opposite sides of the groove.

According to the present invention we provide an assembly of a milling cutter head and cutter tool holders for a rock drilling machine, the cutter tool holders each being mounted by means of a tongue-and-groove connection, the groove being narrowed by a projection from one of its sides and the tongued member of the connection having opposed contact means respectively engageable with corresponding contact means of the grooved member of the connection whereby the two members can be wedgedly locked together, one of the corresponding contact means being constituted by that portion of the projection which is nearer the base of the groove.

Three embodiments of this invention will now be described in further detail, by way of example only, with reference to the drawings.

IN THE DRAWINGS

Figure 1:
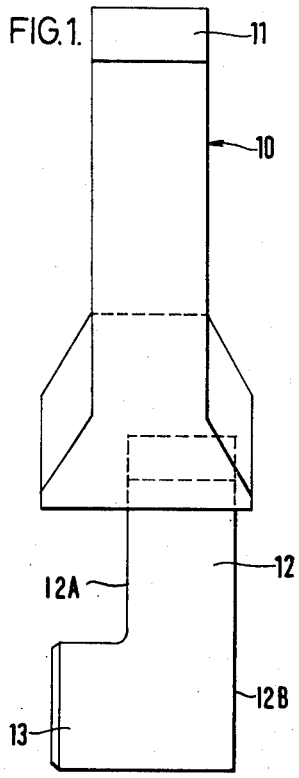
FIG. 1 is a view taken from the front side of a cutter tool holder.
Figure 2:
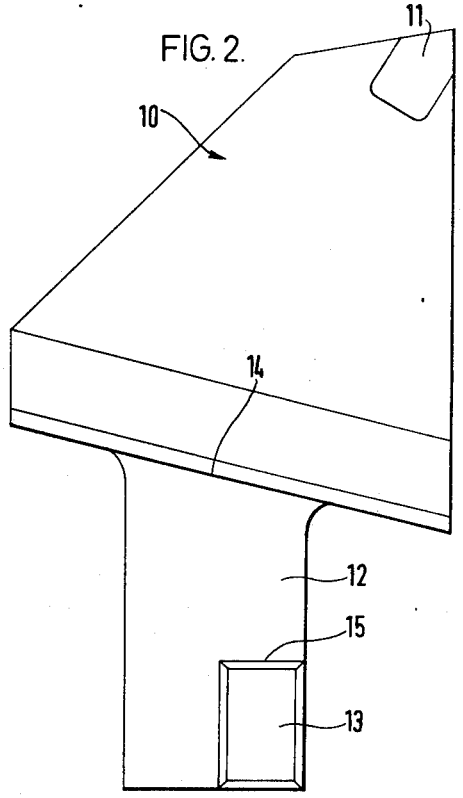
FIG. 2 is a side view of the holder in FIG. 1.

In the accompanying drawings FIGS. 1 and 2 show a tool holder 10 having a cutting insert 11 of a wear-resistant material, usually sintered carbide. The holder 10 has a downwardly projecting extension portion 12. The extension 12 has opposite side walls 12A, 12B. The wall 12B is substantially straight to the end of the extension, while the other side 12A has a lateral projection 13. The holder comprises planar surfaces 14 and 15 which converge, as best seen in FIGS. 2 and 4.

Figure 3:
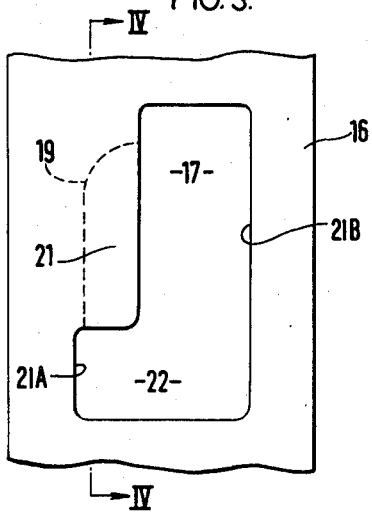
FIG. 3 is a top view of a part of the cutter head.
Figure 4:
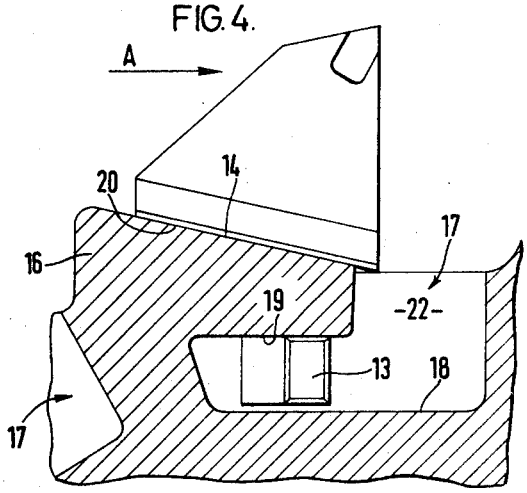
FIG. 4 is a view taken on the line IV—IV of FIG. 3 showing part of a first assembly according to the invention with the cutter head in section but showing the whole cutter tool holder in side view (except where obscured by the cutter head)
Figure 5:
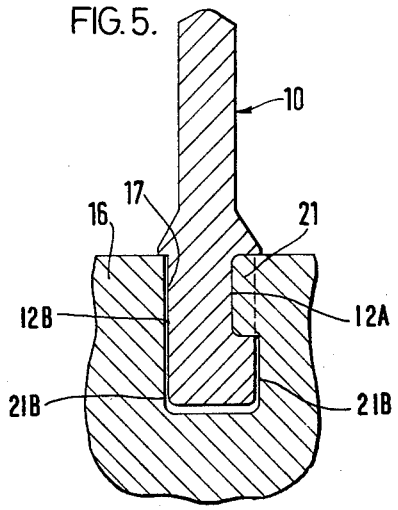
FIG. 5 is a section on the line V—V of FIG. 4.

The holder 10 is carried in a shaft member or directly in a cutter head 16, as shown in FIGS. 3 to 5, by means of a tongue-and-groove connection. The cutter head 16 is to be rotated about its axis so that the cutters move in the direction of arrow A in FIGS. 4 and 6 and at the same time the cutter head is given an orbital movement at right angles to its axis of rotation. In the embodiment illustrated in FIGS. 1 to 5, the tongue-and-groove connection has the form of an L-slot connection which comprises a groove 17 in said shaft or cutter head, the mouth of which groove is narrowed by a single projection 21 from one side 21A so as to form an L-slot as can be seen in FIG. 5. The other side 21B extends substantially straight to a base 18 of the groove. This projection 21 does not run the full length of the groove but rather terminates short of a front end of the groove and therefore has an un-narrowed opening 22 at one end through which the L-shaped tongue can be inserted or removed. The projection 21 has two mutually opposite faces 20 and 19 which converge towards the opening 22 at substantially the same angle as the surfaces 14, 15 of the tool holder. Surfaces 14 and 15 on the cutter head converge at the same angle. The surface 19 is spaced above the base 18 to form an undercut portion of the groove. When the projecting portion 12 of the cutter head is pushed into the opening 22 and along the L-slot, the projection 15 travels along the undercut portion of the groove, with the extension 12 traveling between the projection 21 and the side wall 21B (the distance between the projection 21 and the side wall 21B being greater than the spacing between the sides of the extension). The cutter head becomes rigidly wedged with the surface 15 of the lateral projection 13 abutting the surface 19 of the projection 21, with the surface 14 of the holder 10 abutting the surface 20 of the projection 21, and with the holder 10 held clear of the base 18 of the groove 17.

The wedging angle between the opposed contact surfaces 19 and 20 preferably should be 10° to 15° so that the cutter tool holders become firmly fastened to the cutter head. If the said angle should exceed such values the connection will not be self-locking.

Figure 6:
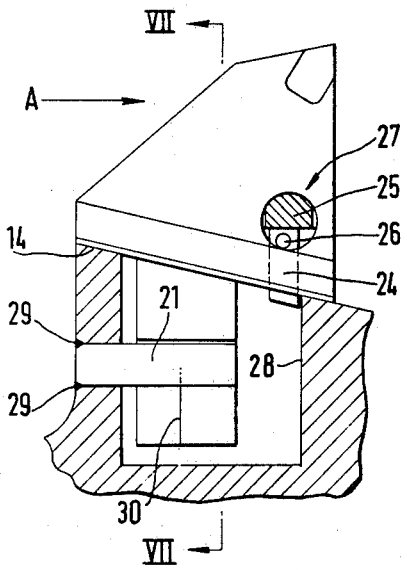
FIG. 6 is a view similar to that of FIG. 4, but showing part of a second assembly according to the invention.
Figure 7:
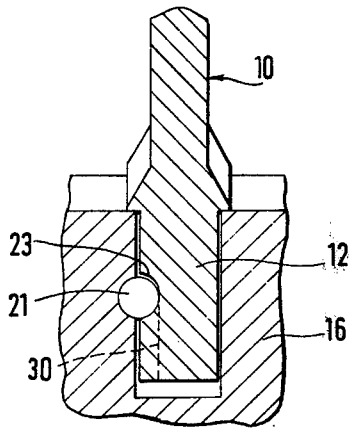
FIG. 7 is a section on the line VII—VII of FIG. 6.

FIGS. 6 and 7 show an alternative embodiment of the invention in which the projection 21 comprises a cylindrical pin secured in the groove 17 by means of a weld 29, and the projecting portion 12 of the holder 10 has a groove 23 in which the projection 21 fits slidingly. The converging contact means on the cutter head 16 are provided by the pin 21 which projects into the groove 17 and the surface of the cutter head adjacent to the groove, and the converging contact means on the tool holder 10 by the groove 23 in the projecting portion 12 and the surface 14. The end of the face of the portion 12 to the left of the line 30 (as seen in FIG. 6) is cut back level with the rear of the groove 23 to enable the tool holder 10 to be removed from the groove 17 on being moved to the right and then upwardly.

FIG. 6 also shows locking means (shown generally at 27) which prevents disengagement of head 16 and holder 10 when the cutters are moved in the direction opposite to that indicated by arrow A, which "reverse rotation" may sometimes be required in coal-mining. The locking means 27 comprises a locking pin 24 and resilient material 25 which urges the pin 24 to extend into the mouth 22 of the groove, so that disengagement of head 16 and holder 10 is prevented by the engagement of the pin 24 with wall 28 of the groove. The locking pin 24 is further provided with a resilient tubular pin 26 for keeping the locking pin 24 in a fixed position. For removal of the holder from the head, pin 24 is urged upwards from the groove by a tool engaging pin 26.

Figure 9:
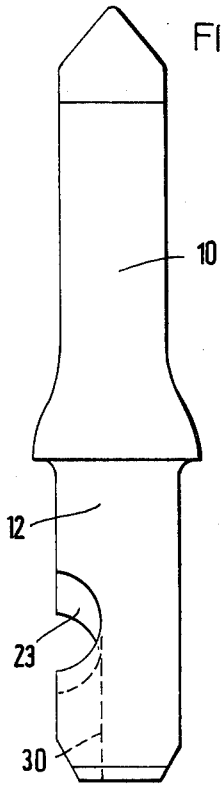
FIG. 9 is a front view of the holder.
Figure 8:
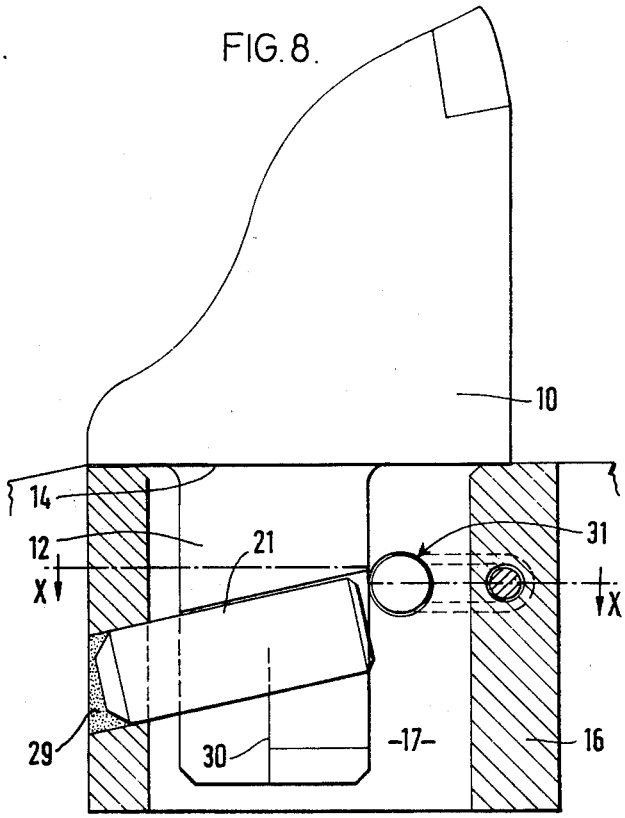
FIG. 8 is a section through part of a cutter head of a third embodiment of the invention showing a cutter tool holder in position.
Figure 10:
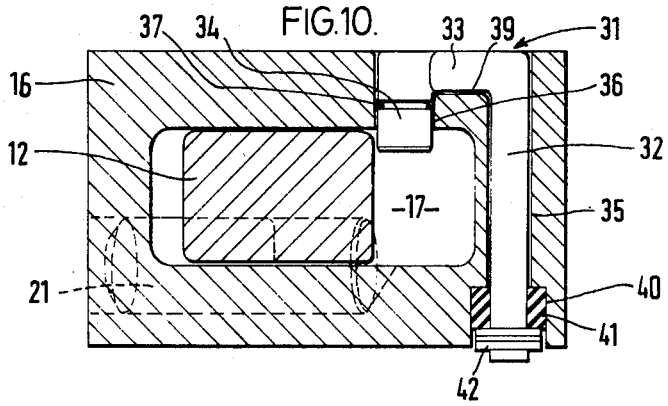
FIG. 10 is a section on the line X—X of FIG. 8.

The embodiment shown in FIGS. 8 to 10 differs from that of FIGS. 6 and 7 in that the downwardly projecting portion 12 of the holder 10 is at right angles or substantially at right angles to the under surface 14 which is to form the upper contact means of the holder. This means that the groove 23 in the projecting portion 12 must be cut at an angle, as shown in the drawings, in order to form the wedging angle with the surface 14. The cylindrical pin 21 is mounted as before in a semicircular recess at the side of the groove 17 in the cutter head 16, where it is welded at 29; it is of course angled in the same way as the groove 23 in the projecting portion 12.

The locking pin 31 is generally J-shaped comprising a longer leg 32, a cross-piece 33 and a shorter leg 34. The two legs are located in bores 35 and 36 in the head 16, the leg 34 being fitted with an O-ring 37 to prevent the passage of dirt. The cross-piece 33 lies in an open passage 39 in the head 16 which connects the two bores 35 and 36.

As seen in FIG. 10, the shorter leg 34 extends inwardly into the groove 17 in which the projecting portion 12 of the holder 10 lies and prevents its removal when in the position shown. The bore 35 passes through the cutter head 16 and, at the end remote from the passage 39 opens out into a cylindrical chamber 40 of greater diameter in which is located a rubber pad 41. A collar 42 fixed adjacent the outer end of the leg 32 of the locking means 31 bears against the rubber pad 41 which biasses the locking means into the position shown.

It can readily be seen that manual pressure on the end of the locking means 31 adjacent the collar 42 can push this against the bias of the rubber pad and the means will move into a position where the shorter leg 34 lies clear of the groove 17, thus allowing the holder 10 to be removed from the cutter head.

Obviously the locking means disclosed in FIGS. 6 and 7, or that disclosed in FIGS. 8 and 10, and be used with any of the embodiments of the invention.

What we claim is:

1. An assembly of a milling cutter head and cutter tool holders for a rock drilling machine, each holder mounted by a tongue and groove connection comprising:

an outwardly open groove formed in said cutter head, said groove including opposite side walls each extending from a front end to a rear end of said groove, one of said side walls being substantially straight along its height, said other side wall including a first projection extending laterally toward said one side wall, said first projection including a first contact surface forming therebeneath an undercut portion of said groove extending in a front-to-rear direction, said first projection terminating short of said front end of said groove to define an enlarged opening, said cutter head including a second contact surface spaced outwardly of said first contact surface and extending at an angle relative thereto, and a tongue comprising an extension of said tool holder, said extension including opposite side walls spaced by a distance less than the distance between said first projection and said one side wall of said groove, one of said side walls of said extension extending substantially straight to the end of said extension, the other of said side walls of said extension including a second projection extending laterally in a direction away from said one side of said extension, said second projection including a third contact surface, said tool holder including a fourth contact surface spaced from said third contact surface and extending at an angle relative thereto, which spacing and angle corresponds substantially to that defined by said first and second contact surfaces, said enlarged opening to said groove being sized to receive said extension and said second projection such that upon movement of said tool holder toward said rear end of said groove, said extension travels between said first projection and said one wall of said groove and said second projection travels along said undercut portion of said groove, with said first and third contact surfaces and said second and fourth contact surfaces contacting one another to wedgingly secure said tool holder to said cutter head.

2. An assembly according to claim 1 wherein said first projection comprises a pin mounted in said other side wall of said groove and extending generally in a front-to-rear direction.

3. An assembly according to claim 2 wherein said second projection is defined by a recess in said tongue, said recess shaped similar to said pin and receiving the latter when said tool holder is inserted into said groove.

4. An assembly according to claim 1, including locking means carried by said tool holder, said locking means comprising a lock pin and yieldable biasing means urging said pin into said groove to prevent unintentional removal of said tool holder from said groove.

5. An assembly according to claim 1, including locking means carried by said cutter head, said locking means including a J-shaped lock pin having a long leg and a parallel short leg, said long leg extending substantially perpendicular to the front-to-rear direction of said groove, said short leg being arranged to project into said groove in a first position of said lock pin to block removal of said tool holder, and biasing means arranged to urge said lock pin toward said first position, said biasing means being yieldable to enable said short leg to be withdrawn from blocking relation with said tool holder.

* * * * *

UNITED STATES PATENT AND TRADEMARK OFFICE

CERTIFICATE OF CORRECTION

PATENT NO. : 4,180,292

DATED : December 25, 1979

INVENTOR(S) : Erik A. Persson

It is certified that error appears in the above-identified patent and that said Letters Patent are hereby corrected as shown below:

On the first page, under "Filed: Feb. 27, 1978" please insert:

--Foreign Application Priority Data

| | | |
|---|---|---|
| Mar. 3, 1977 | Great Britain..... | 9074/77 |
| Nov. 29, 1977 | Great Britain..... | 49698/77-- |

Signed and Sealed this

*Thirtieth* Day of *December 1980*

[SEAL]

*Attest:*

SIDNEY A. DIAMOND

*Attesting Officer*

*Commissioner of Patents and Trademarks*